US011452416B2

(12) United States Patent
Ryou et al.

(10) Patent No.: US 11,452,416 B2
(45) Date of Patent: Sep. 27, 2022

(54) CLEANER

(71) Applicant: LG ELECTRONICS INC., Seoul (KR)

(72) Inventors: Kyoungho Ryou, Seoul (KR); Jungwan Ryu, Seoul (KR); Sungjun Kim, Seoul (KR); Hwayeong Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 184 days.

(21) Appl. No.: 15/931,453

(22) Filed: May 13, 2020

(65) Prior Publication Data

US 2020/0383537 A1 Dec. 10, 2020

(30) Foreign Application Priority Data

Jun. 5, 2019 (KR) ..... 10-2019-0066870
Jul. 8, 2019 (KR) ..... 10-2019-0082222

(51) Int. Cl.
*A47L 9/10* (2006.01)
*A47L 9/12* (2006.01)
(Continued)

(52) U.S. Cl.
CPC ..... *A47L 9/108* (2013.01); *A47L 9/127* (2013.01); *A47L 9/1409* (2013.01); *A47L 9/2884* (2013.01); *A47L 9/322* (2013.01)

(58) Field of Classification Search
CPC ..... A47L 9/108; A47L 9/127; A47L 9/1409; A47L 9/2884; A47L 9/322
See application file for complete search history.

(56) References Cited

U.S. PATENT DOCUMENTS 8,152,913 B2 4/2012 Oh
10,130,226 B2 11/2018 Shin et al.
(Continued)

FOREIGN PATENT DOCUMENTS

CN 1545973 A 11/2004
CN 105640433 A 6/2016
(Continued)

OTHER PUBLICATIONS

Chinese Office Action issued in correspondence Chinese Patent Application No. 202080006239.3 dated Dec. 31, 2021, with English Translation.

*Primary Examiner* — Andrew A Horton
(74) *Attorney, Agent, or Firm* — Dentons US LLP

(57) ABSTRACT

Provided is a cleaner. The cleaner includes a housing provided with a dust container at a lower side thereof having a suction opening, a filter part configured to filter dust from air suctioned through the suction opening, the filter being spaced apart from an inner circumferential surface of the housing, an air guide configured to guide the air passing through the filter part in an inner region of the filter part to a suction motor configured to generate suction force, a movable part configured to be elevated between a first position and a second position in a space between the outside of the filter part and the inner circumferential surface of the housing, a manipulation part of which at least a portion is exposed to outside of the housing, the manipulation part being elevated by user's manipulation, and a transfer unit of which at least a portion is accommodated in the housing, the transfer unit being configured to connect the manipulation part to the movable part.

14 Claims, 10 Drawing Sheets

(51) Int. Cl.

| | |
|---|---|
| ***A47L 9/28*** | (2006.01) |
| ***A47L 9/14*** | (2006.01) |
| ***A47L 9/32*** | (2006.01) |

(56) References Cited

U.S. PATENT DOCUMENTS

| | | | |
|---|---|---|---|
| 2018/0132685 | A1 | 5/2018 | Muir et al. |
| 2018/0132686 | A1 | 5/2018 | Muir et al. |

FOREIGN PATENT DOCUMENTS

| | | | |
|---|---|---|---|
| CN | 108065862 | A | 5/2018 |
| CN | 109640767 | A | 4/2019 |
| JP | 2013-022224 | A | 2/2013 |
| JP | 2019-042532 | A | 3/2019 |
| KR | 10-2010-0093444 | A | 8/2010 |
| KR | 10-2016-0065610 | A | 6/2016 |

CLEANER

CROSS-REFERENCE TO RELATED APPLICATIONS

The present application claims priority under 35 U.S.C. 119 and 35 U.S.C. 365 to Korean Patent Application No. 10-2019-0066870, filed on Jun. 5, 2019, which is hereby incorporated by reference in its entirety.

BACKGROUND

The present disclosure relates to a vacuum cleaner having a dust compression function.

Cleaners are devices that suctions or washes dusts or foreign substances on an object area to be cleaned so as to perform cleaning.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Prior Art Document: US Patent Publication US2018/0132685A1

The prior art document discloses a cleaning mechanism including a dust compression part that compresses dust in a dust container.

The cleaning mechanism includes a dust container having an opening, a filter for purifying air in the dust container, a shroud surrounding the filter, a dust compression part disposed to surround the shroud, a handle manipulated by a user to allow the dust compression part to move, and a link connected to the handle.

Operation force of the handle is transmitted to the dust compression part through the link so that the dust compression part descends to compress the dust in the dust container.

According to the related art, when using a cleaner that does not have the dust compression function, if dust is accumulated in the dust container, it is forced to empty the dust container immediately. Therefore, the dust container is filled up quickly to decrease in cycle for emptying the dust container. As a result, there is a troublesome problem.

Also, there is a limitation that dust is blown when emptying the dust container.

However, like the prior art document, if the structure for compressing the dust container is applied, when the dust is filled in the dust container, a volume of the dust may be reduced by compressing the dust.

Therefore, the dust container does not need to be emptied frequently due to the dust compression, and there is an advantage in that the phenomenon of dust blowing when emptying the dust is reduced.

However, while the structure for compressing dust is provided inside the dust container, a limitation that dust enters a rail part along which the dust compression part moves occurs.

Particularly, in the dust container, when the dust compression part descends, the rail part above the dust compression part is opened to the outside, and dust is introduced into a gap.

As described above, when the dust in the dust container is introduced into the rail part, the dust acts as an obstacle to elevate the dust compression part so that the elevation operation of the dust compression part is not performed smoothly.

Particularly, when the dust compression part descends, the ascending operation of the dust compression part may be disturbed due to the dust caught in the rail part disposed above the dust compression part.

Also, the user has to apply large force to forcibly lift the dust compression part, and since the large force is applied to the dust compression part, the component such as the dust container or the dust compression part may be damaged.

Therefore, it is necessary to block the dust so that the dust of the dust container is not introduced into the rail part provided in the dust container.

SUMMARY

Embodiments provide a cleaner that compresses dust introduced into a dust container and blocks dust and foreign substances from the dust container into an elevation groove defined in the dust container during an elevation operation of a movable part and a transfer part.

Embodiments also provide a cleaner in which a gap is not generated between a transfer part and an elevation groove acting as an elevation space of the transfer part to prevent dust and foreign substances from being caught in the gap.

Embodiments also provide a cleaner in which a movable part and a transfer part, which are elevated to compress dust inside a dust container, are smoothly elevated.

In one embodiment, a cleaner includes a housing provided with a dust container at a lower side thereof having a suction opening and a movable part configured to be elevated between an upper side and a lower side of the dust container to compress dust within the dust container.

The cleaner may further include a filter part configured to filter dust from air suctioned through the suction opening, the filter being spaced apart from an inner circumferential surface of the housing.

The cleaner may further include an air guide configured to guide the air passing through the filter part in an inner region of the filter part to a suction motor configured to generate suction force.

The movable part may be elevated between a first position and a second position in a space between the outside of the filter part and the inner circumferential surface of the housing.

The cleaner may further include a manipulation part of which at least a portion is exposed to outside of the housing, the manipulation part being elevated by user's manipulation.

The cleaner may further include a transfer unit of which at least a portion is accommodated in the housing, the transfer unit being configured to connect the manipulation part to the movable part.

The transfer unit may include: a second transfer part extending upward from one side of the movable part; and a first transfer part configured to connect an upper side of the second transfer part to an upper side of the manipulation part.

The dust container may have an elevation groove defined vertically to be recessed outward from an inner surface of the dust container When the movable part is elevated, at least a portion of the second transfer part may be accommodated into and guided by the elevation groove.

A transverse cross-section of the second transfer part may correspond to a transverse cross-section of the elevation groove.

When the second transfer part descends, an inlet of the elevation groove may be blocked by a blocking wall disposed at one side of the second transfer part, which faces a central portion of the dust container.

An inclined surface that is inclined downward to the inside of the dust container may be disposed on a lower end of the elevation groove.

A protruding body protruding outward by the elevation groove may be disposed on an outer surface of the housing.

The second transfer part may include: a central shaft having a lower end connected to the movable part and an upper end connected to the first transfer part; and a cover portion which is configured to define an outer appearance of the second transfer part while covering the central shaft and through which the central shaft passes.

The elevation groove or the second transfer part may have a curved shape because one side facing the outside of the dust container has an arc shape.

The movable part may be elevated between upper and lower ends of the dust container.

A portion of the manipulation part, which is exposed to the outside of the housing, may extend in a horizontal direction.

The cleaner may further include an elastic member providing elastic force to the manipulation part or the transfer unit.

The elastic member may provide force that pushes the manipulation part upward.

A support bar extending vertically may be installed outside the housing, and the elastic member may be inserted into an outer circumferential surface of the support bar.

A handle part may be disposed outside the housing, and the manipulation part may be disposed adjacent to one side of the handle part.

The details of one or more embodiments are set forth in the accompanying drawings and the description below. Other features will be apparent from the description and drawings, and from the claims.

DETAILED DESCRIPTION OF THE EMBODIMENTS

Figure 1:
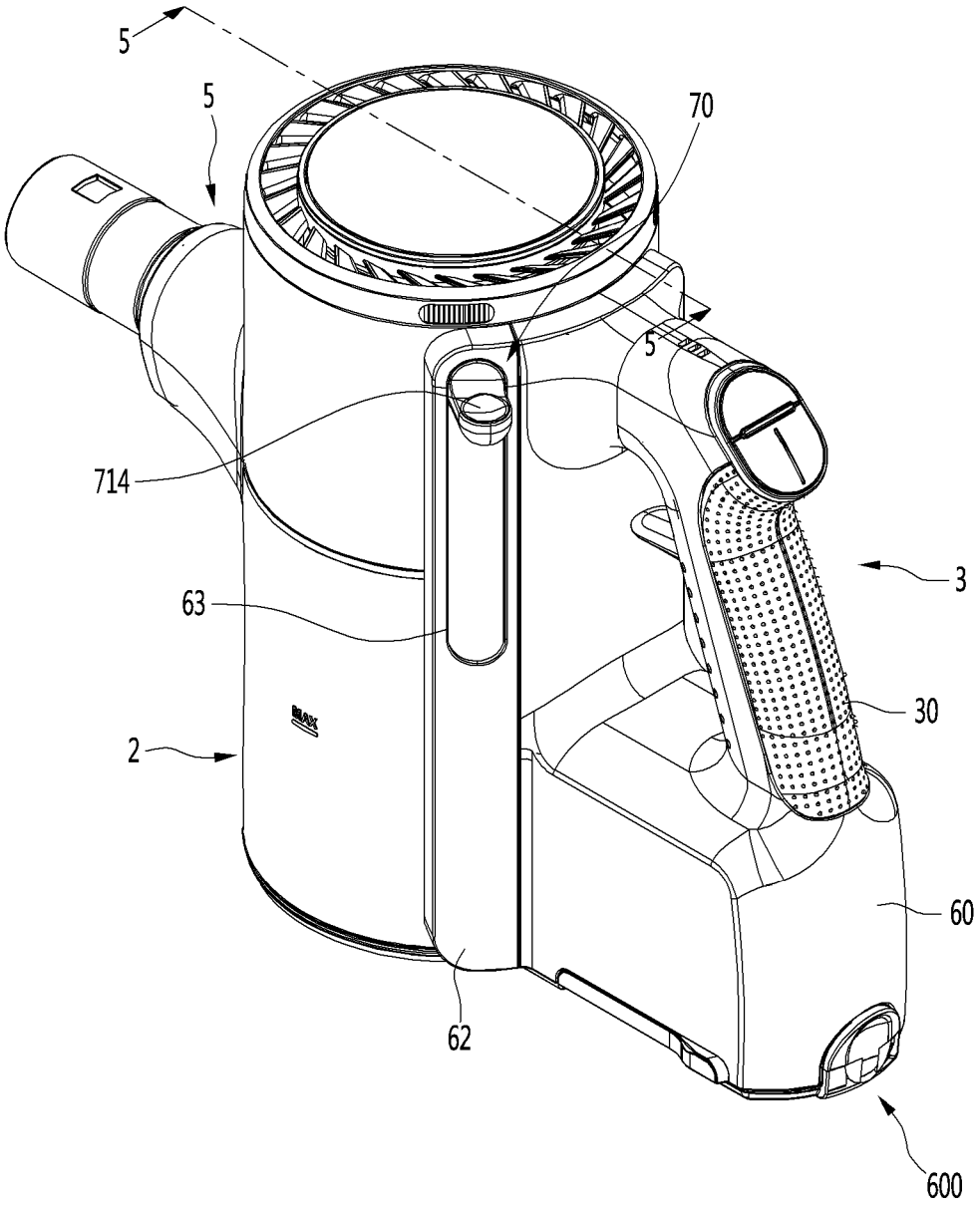
FIG. 1 is a perspective view of a cleaner according to an embodiment.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected % coupled" or "joined" to the latter with a third component interposed therebetween.

Figure 2:
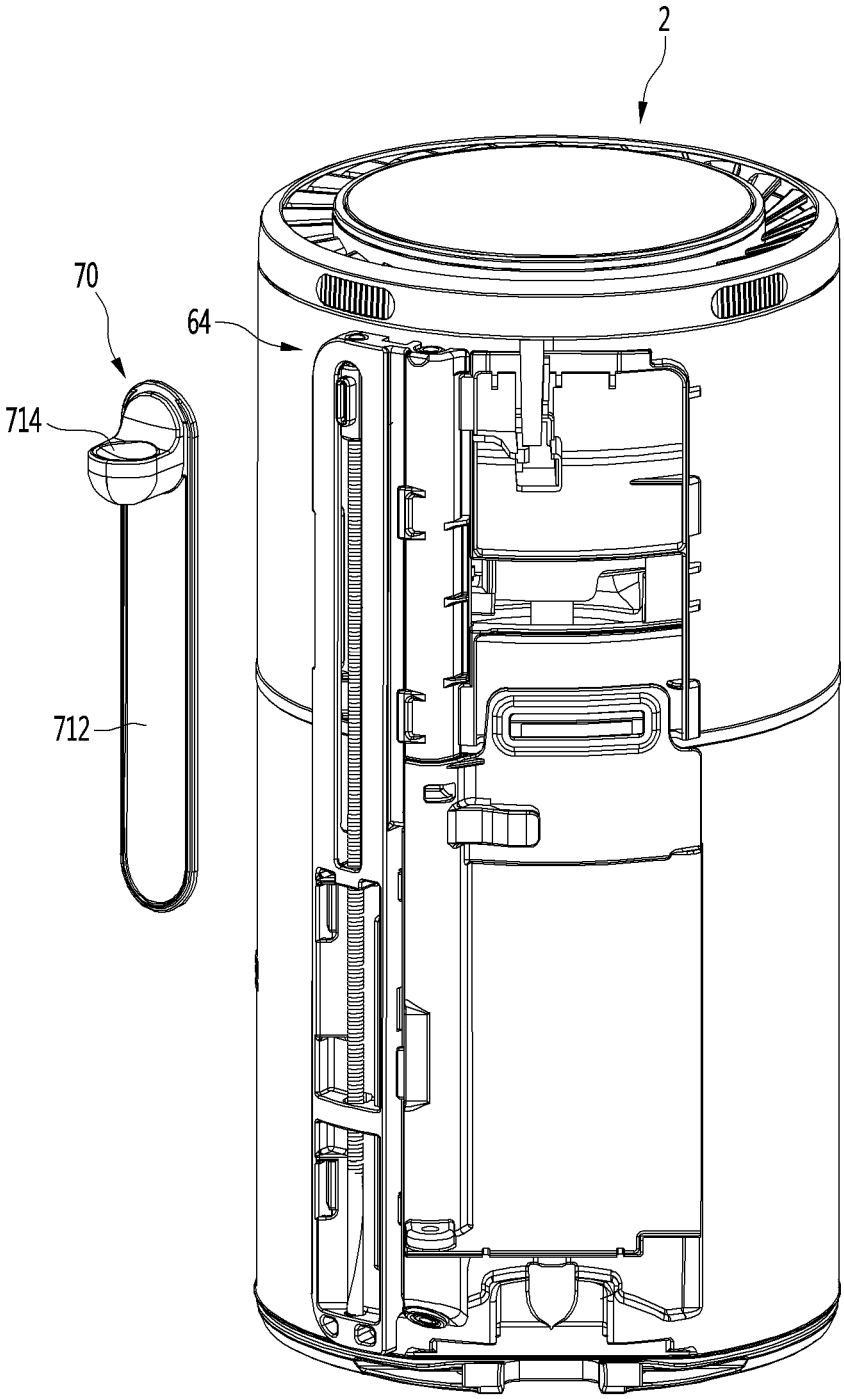
FIG. 2 is a perspective view illustrating a state in which a handle part is separated from the cleaner according to an embodiment.
Figure 3:
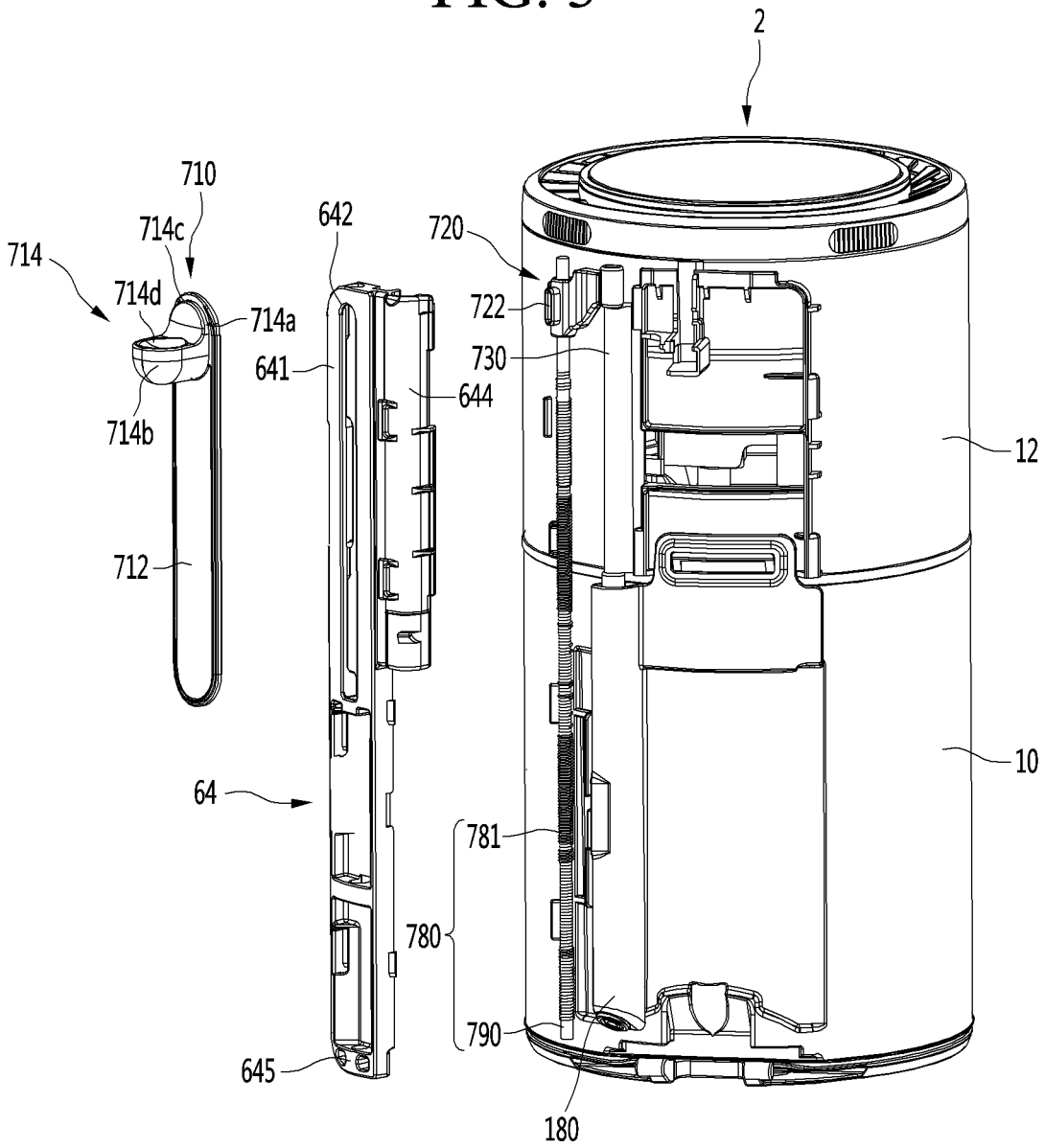
FIG. 3 is a view illustrating a state in which a guide frame is separated in FIG. 2.
Figure 4:
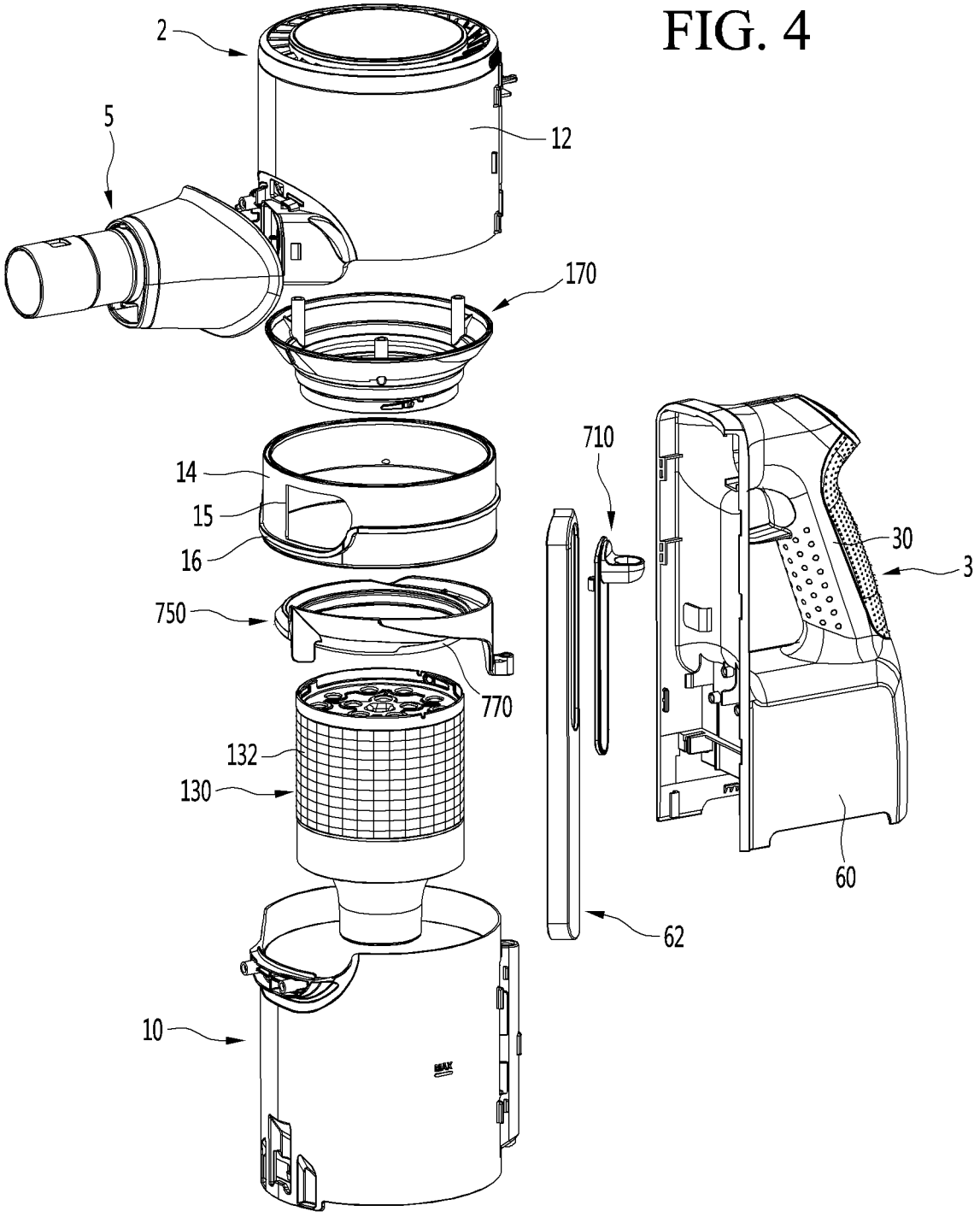
FIG. 4 is an exploded perspective view of the cleaner according to an embodiment.
Figure 5:
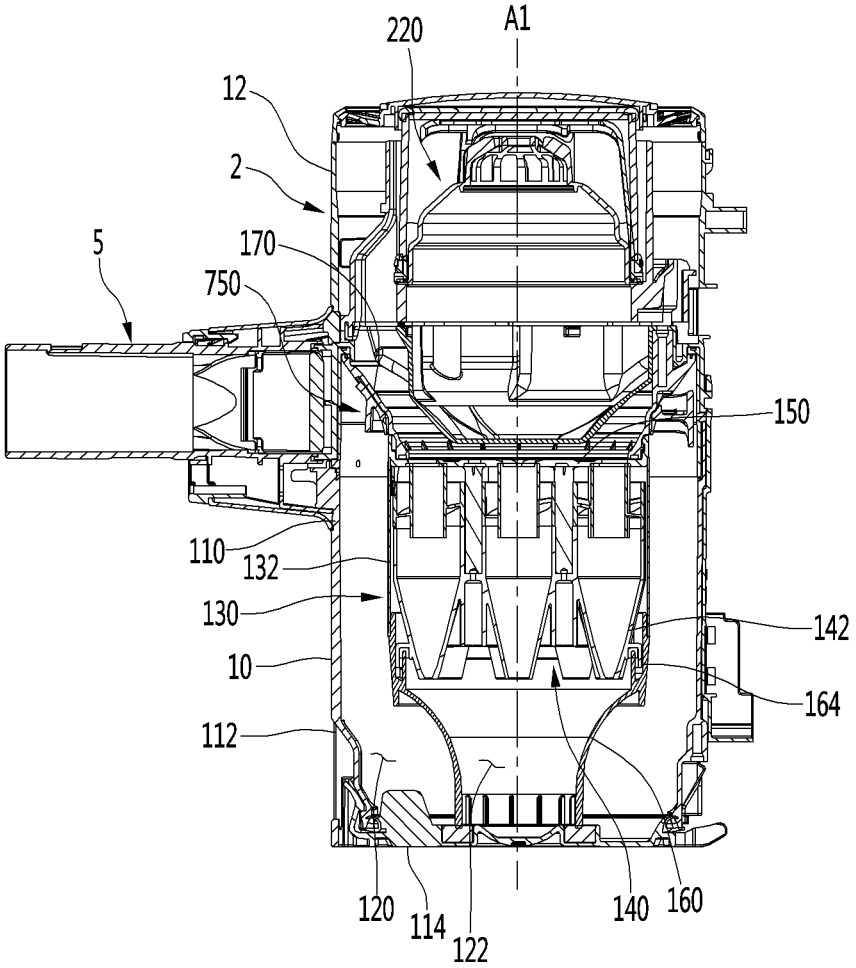
FIG. 5 is a cutaway cross-sectional view taken along line 5-5 of FIG. 1.

FIG. 1 is a perspective view of a cleaner according to an embodiment, FIG. 2 is a perspective view illustrating a state in which a handle part is separated from the cleaner according to an embodiment, FIG. 3 is a view illustrating a state in which a guide frame is separated in FIG. 2, and FIG. 4 is an exploded perspective view of the cleaner according to an embodiment. FIG. 5 is a cutaway cross-sectional view taken along line 5-5 of FIG. 1.

Referring to FIGS. 1 to 5, a cleaner 1 according to an embodiment may include a main body 2. The cleaner 1 may include a suction part 5 through which air containing dust is suctioned. The suction part 5 may guide air containing dust into the main body 2.

The cleaner 1 may further include a handle part 3 coupled to the main body 2. The handle part 3 may be disposed at a side that is opposite to the suction part 5 in the main body 2. However, the positions of the suction part 5 and the handle part 3 are not limited thereto.

The main body 2 may separate dust suctioned into the inside thereof through the suction part 5 to store the separated dust.

For example, the main body 2 may include a dust separator. The dust separator may include a first cyclone part 180 that is capable of separating dust through a cyclonic flow. The first cyclone part 110 may communicate with the suction part 5.

The air and dust suctioned through the suction part 5 helically flow along an inner circumferential surface of the first cyclone part 180.

The dust separator may further include a second cyclone part 140 that secondarily separates dust from the air discharged out of the first cyclone part 110.

The second cyclone part 140 may include a plurality of cyclone bodies that are disposed in parallel to each other. The air may be divided to pass through the plurality of cyclone bodies 142.

For another example, it may be also possible that the dust separator has a single cyclone part.

For example, the main body 2 may have a cylindrical shape, and an outer appearance of the main body 2 may be defined by a plurality of housings.

For example, the main body 2 may include a substantially cylindrical first housing 10 and a substantially cylindrical second housing 12 coupled to an upper side of the first housing 10.

An upper side of the first housing 10 may define the first cyclone part 110, and a lower side of the first housing 10 may define the dust container 112 in which the dust separated in the first cyclone part 110 is stored.

The lower side of the first housing 10 (i.e., a lower side of the dust container 112) may be opened and closed by a housing cover 114 that rotates by a hinge.

To seal a boundary between the first housing 10 and the second housing 12 in a state in which the first housing 10 and the second housing 12 are coupled to each other, the cleaner 1 may further include a sealing member 16 and a support body 14 supporting the sealing member 16.

The first housing 10 and the second housing 12 have opened upper and lower sides, respectively. That is, the housings 10 and 12 may have an upper opening and a lower opening, respectively.

The support body 14 may have a cylindrical shape. Here, an outer diameter of the support body 14 may be equal to or less than an inner diameter of the first housing 10 so that the support body 14 is inserted into the first housing 10 through the upper opening of the first housing 10.

The outer diameter of the support body 14 may be equal to or less than an inner diameter of the second housing 12 so that the support body 14 is inserted into the second housing 12 through the lower opening of the second housing 12.

The support body 14 may include a communication opening 15 through which air passes.

The sealing member 16 may be coupled to the support body 14 to surround an outer circumferential surface of the support body 14. For example, the sealing member 16 may be integrated with the support body 14 by insert-injection. Alternatively, the sealing member 16 may be coupled to an outer circumferential surface of the support body 14 by an adhesive.

The main body 2 may include a suction opening through which air guided through the suction part 5 is introduced.

For example, one of the first housing 10 and the second housing 12 may have the suction opening, or the first housing 10 may define one portion of the suction opening, and the second housing 12 may define the other portion of the suction opening.

Hereinafter, a structure in which the second housing 12 includes the suction opening will be described as an example.

When the second housing 12 is coupled to the first housing 10, the suction opening 12*a* of the second housing 12 and the communication opening 15 of the support body 14 are aligned with each other.

The suction opening 12*a* is aligned with the suction part 5. Thus, dust and air may be introduced into the first cyclone part 110 through the inside of the suction part 5, the suction opening 12*a*, and the communication opening 15.

In this embodiment, the support body 14 may be omitted. In this case, an upper end of the first housing 10 may directly contact a lower end of the second housing 12. Also, dust and air may be introduced into the first cyclone part 110 through the suction opening 12*a* after passing through the inside of the suction part 5.

In this specification, a constituent for guiding the air from the suction part 5 to the first cyclone part 110 may be referred to as a suction passage of the main body 2.

In summary, the suction passage may include only the suction opening 12*a* or may include the suction opening 12*a* and the communication opening 15.

The body 2 may further include a filter part 130 disposed to surround the second cyclone part 140.

For example, the filter part 130 has a cylindrical shape and guides the air separated from the dust in the first cyclone part 110 to the second cyclone part 140. The filter part 130 filters dust while air passes therethrough.

For this, the filter part 130 may include a mesh portion 132 having a plurality of holes. The mesh portion 132 is not limited, but may be made of a metal material.

Since the mesh portion 132 filters the air, dust may be accumulated on the mesh portion 132, and thus, the mesh portion 132 needs to be cleaned.

Thus, according to an embodiment, the cleaner 1 may further include a cleaning mechanism 70 for cleaning the filter part 130.

The cleaning mechanism 70 includes a movable part 750 movable in the main body 2, a manipulation part 710 manipulated by a user to allow the movable part 750 to move, and transfer units 720 and 730 that transfer operation force of the manipulation part 710 to the movable part 750.

The manipulation part 710 may be disposed outside the main body 2. For example, the manipulation part 710 may be disposed outside the first housing 10 and the second housing 12.

Also, the manipulation part 710 may be disposed adjacent to the handle part 3. Thus, the user may easily manipulate the manipulation part 710 disposed near the handle part 3 when dust compression is needed while the user grips the handle part 3.

Also, at least a portion of the manipulation part 710 may be disposed higher than the second housing 10. Also, at least a portion of the manipulation part 710 may be disposed higher than the movable part 750.

The guide part 710 may include a pressing portion 714. The pressing portion 714 may be disposed higher than the first housing 10 and the movable part 750.

In the manipulation part 710, a portion at which the pressing portion 714 is disposed may extend horizontally, and the pressing portion 714 may be recessed downward.

The manipulation part 710 may further include a manipulation part body 712. The manipulation part body 712 may have a vertical length that is relatively longer than a left-right width thereof. The pressing portion 714 may protrude upward from the manipulation part body 712.

The pressing portion 714 may protrude from the manipulation part body 712 in a horizontal direction while the manipulation part body 712 is disposed in a vertical direction.

For example, the pressing portion 714 may be disposed closer to an upper end than a lower end of the manipulation part body 712.

The pressing portion 714 may protrude from a position that is spaced downward from an upper end of the manipulation part body 712.

The pressing portion 714 may include a first portion 714*a* protruding from the manipulation part body 712 and a second portion 714*b* additionally protruding from the first pressing portion 714*a*.

The second portion 714*b* may protrude from a position that is spaced downward from an upper end of the first portion 714*a* by a predetermined distance.

The user may press a top surface 714*d* of the second portion 714*b* to allow the manipulation part 710 to move downward. Thus, the top surface 714*d* of the second portion 714*b* serves as a pressing surface.

The manipulation part 710 may further include a coupling protrusion (see reference numeral 716 of FIG. 6) disposed at an opposite side of the pressing portion 714 from the manipulation part body 712.

The handle part 3 may include a handle body 30 for the gripping of the user and a battery housing 60 disposed below the handle body 30 to accommodate a battery 600.

The handle body 30 and the battery housing 60 may be disposed in the vertical direction, and the handle body 30 may be disposed above the battery housing 60.

The handle part 3 may guide the movement of the manipulation part 710 while covering a portion of the manipulation part 710.

For example, the handle part 3 may further include a manipulation part cover 62. The manipulation part cover 62 may be disposed at a side of the handle body 30 and the battery housing 60.

The manipulation part cover 62 may be integrated with the handle body 30 and the battery housing 60 or may be separately provided.

When the manipulation part cover 62 is separately provided with respect to the handle body 30 and the battery housing 60, the manipulation part cover 62 may be coupled to the main body 2.

The manipulation part 710 may be disposed at a left side of the handle body 30 while the user grips the handle body 30 with his right hand.

Thus, the manipulation part 710 may be easily manipulated with the left hand that does not grip the handle body 30.

The manipulation part 710 may move in a direction parallel to an axis A1 of the cyclone flow of the first cyclone part 110.

For example, the axis A1 of the cyclone flow of the first cyclone part 110 may extend in the vertical direction in a state in which the dust container 112 is placed on the floor.

Thus, the manipulation part 710 may also move in the vertical direction in the state in which the dust container 112 is placed on the floor.

A slot 63 may be defined in the manipulation part cover 62 to allow the manipulation part 710 to move therethrough. The pressing portion 714 of the manipulation part 710 may pass through the slot 63.

The vertical length of the manipulation part body 712 may be longer than a length of the slot 63. The left-right width of the manipulation part body 712 may be longer than that of the slot 63.

The left-right width of the pressing portion 714 may be equal to or smaller than that of the slot 63. The vertical length of the pressing portion 714 may be smaller than that of the slot 63.

A protruding length of the pressing portion 714 may be larger than a front-rear width of the manipulation part cover 62.

Thus, the pressing portion 714 may pass through the slot 63 and may protrude to the outside of the manipulation part cover 62 in the state of passing through the slot 63.

The left-right width of the manipulation part body 712 may be smaller than that of the manipulation part cover 62. The vertical length of the manipulation part body 712 may be smaller than the left-right width of the manipulation part cover 62.

The front-rear width of the manipulation part body 712 may be smaller than that of the manipulation part cover 62. The manipulation part cover 62 may define a space in which the manipulation part body 712 is disposed. The manipulation part body 712 may move upward and downward in the state in which the manipulation part body 712 is disposed in the manipulation part cover 62.

The manipulation part body 712 may move between a first position and a second position within the manipulation part cover 62.

The first position is a position when the manipulation part body 712 moves to the uppermost side, and the second position is a position when the manipulation part body 712 moves to the lowermost side.

The manipulation part body 712 may be disposed at the first position in a state in which no external force is applied to the manipulation part 710.

The manipulation part body 712 may cover the slot 63 in the state in which the manipulation part body 712 is disposed at the first position.

For example, in the state in which the manipulation part body 712 is disposed at the first position, the manipulation part body 712 may cover the entirety of the slot 63 inside the manipulation part cover 62. Thus, the manipulation part body 712 may be exposed to the outside of the slot 63 in the state in which the manipulation part body 712 is disposed at the first position, and a space inside the manipulation part cover 62 may be prevented from being exposed to the outside.

The slot 63 may also extend in a direction parallel to the extension direction of the axis A1 of the cyclone flow of the first cyclone portion 110.

In this embodiment, since the extension direction of the axis A1 of the cyclone flow is the vertical direction as an example in the drawing, the "vertical direction" described below may be understood as the extension direction of the axis A1 of the cyclone flow.

Since the movable part 750 is disposed in the main body 2, and the manipulation part 710 is disposed outside the main body 2, a portion of each of the transfer units 720 and 730 may be disposed outside the main body 2, and the other portion may be disposed inside the main body 2 so that the movable part 750 and the manipulation part 710 are connected to each other.

A portion of each of the transfer units 720, 730 may pass through the body 2. A portion of each of the transfer units 720 or 730 disposed outside the main body 2 may be covered by the handle part 3.

The transfer units 720 and 730 may include a first transfer part 720. The first transfer part 720 may be coupled to the manipulation part 710. For example, the first transfer part 720 may include a coupling protrusion 722. The coupling protrusion 722 may be coupled to the protrusion coupling portion disposed on the manipulation part body 712.

The coupling protrusion 722 may have a vertical length greater than a left-right width thereof. The coupling protrusion 722 may limit relative rotation of the manipulation part 710 in the horizontal direction with respect to the first transfer part 720.

The transfer units 720 and 730 may further include a second transfer part 730 coupled to the movable part 750.

A portion of the second transfer part 730 may be disposed inside the main body 2, and the other part may be disposed outside the main body 2.

The second transfer part 730 may be directly connected to the first transfer part 720 or may be connected by an additional transfer part.

In FIG. 3, for example, the second transfer part 730 is directly connected to the first transfer part 720.

The main body 2 may further include a protruding body 180 for guiding the second transfer part 730. For example, the protruding body 180 protrudes to the outside of the first housing 10.

The protruding body 180 may extend in a direction parallel to the extension direction of the axis A1 of the cyclone flow of the first cyclone part 110.

The protruding body 180 may communicate with an internal space of the first housing 10, and the second transfer part 730 may move in the protruding body 180. For reference, since the protruding body 180 is provided, an elevation groove 190 (see FIG. 8) may be defined vertically inside the dust container 112.

The cleaner 1 may further include a support mechanism 780 for elastically supporting the cleaning mechanism 70.

The support mechanism 780 may include an elastic member 781 for providing elastic force to the cleaning mechanism 70.

The elastic member 781 may provide elastic force to the manipulation part 710 or the transfer units 720 and 730.

The elastic member 781 has elastic restoring force to provide force for allowing the manipulation part 710 to return to a first position (that is a position of the manipulation part 710 before the user presses the manipulation part 710).

For example, the elastic member 781 provides force for pushing the manipulation part 710 upward.

As described above, when the elastic member 781 provides force for pushing the manipulation part 710 upward, the user presses the manipulation part 710 downward to compress dust, and then, when the user takes his/her hands off from the manipulation part 710 or release the pressing force, the manipulation part 710 move upward by itself by the elastic restoring force of the elastic member 781 to return to its original position (first position).

Hereinafter, a structure in which the elastic member 781 supports the manipulation part 710 will be described as example.

The elastic member 781 may be spaced apart from the second transfer part 730 in a horizontal direction.

The elastic member 781 may be, for example, a coil spring and may be contracted and expanded in the vertical direction.

Here, a length of the elastic member 781 may be longer than that of the second transfer part 730 at the first position (the position of the manipulation part 710 before the user presses the manipulation part 710) of the manipulation part 710.

When the length of the elastic member 781 is longer than that of the second transfer part 730, the manipulation part 710 may be supported using the elastic member 781 having a low elastic modulus.

In this case, when pressing the manipulation part 710, the required force may be reduced. In addition, when the manipulation part 710 returns to its original position by the elastic member 781, noise generated while an upper end 714*c* of the first portion 714*a* collides with a surface defining the slot of the manipulation part cover 62 may be reduced in the pressing portion 714.

The support mechanism 780 may further include a support bar 790 that supports the elastic member 781 so that the horizontal movement of the elastic member 781 is limited during the vertical movement of the manipulation part 710.

For example, the support bar 790 may have a cylindrical shape. A vertical length of the support bar 790 may be longer than that of the elastic member 781.

The elastic member 781 may be disposed to surround the support bar 790.

That is, the support bar 790 may be disposed in an inner region of the coil-shaped elastic member 781. An outer diameter of the support bar 790 may be equal to or smaller than an inner diameter of the elastic member 781.

One end of the support bar 790 may be fixed to the main body 2 or a transfer unit cover that will be described below. The first transfer part 720 may be coupled to the other end of the support bar 790.

Figure 6:
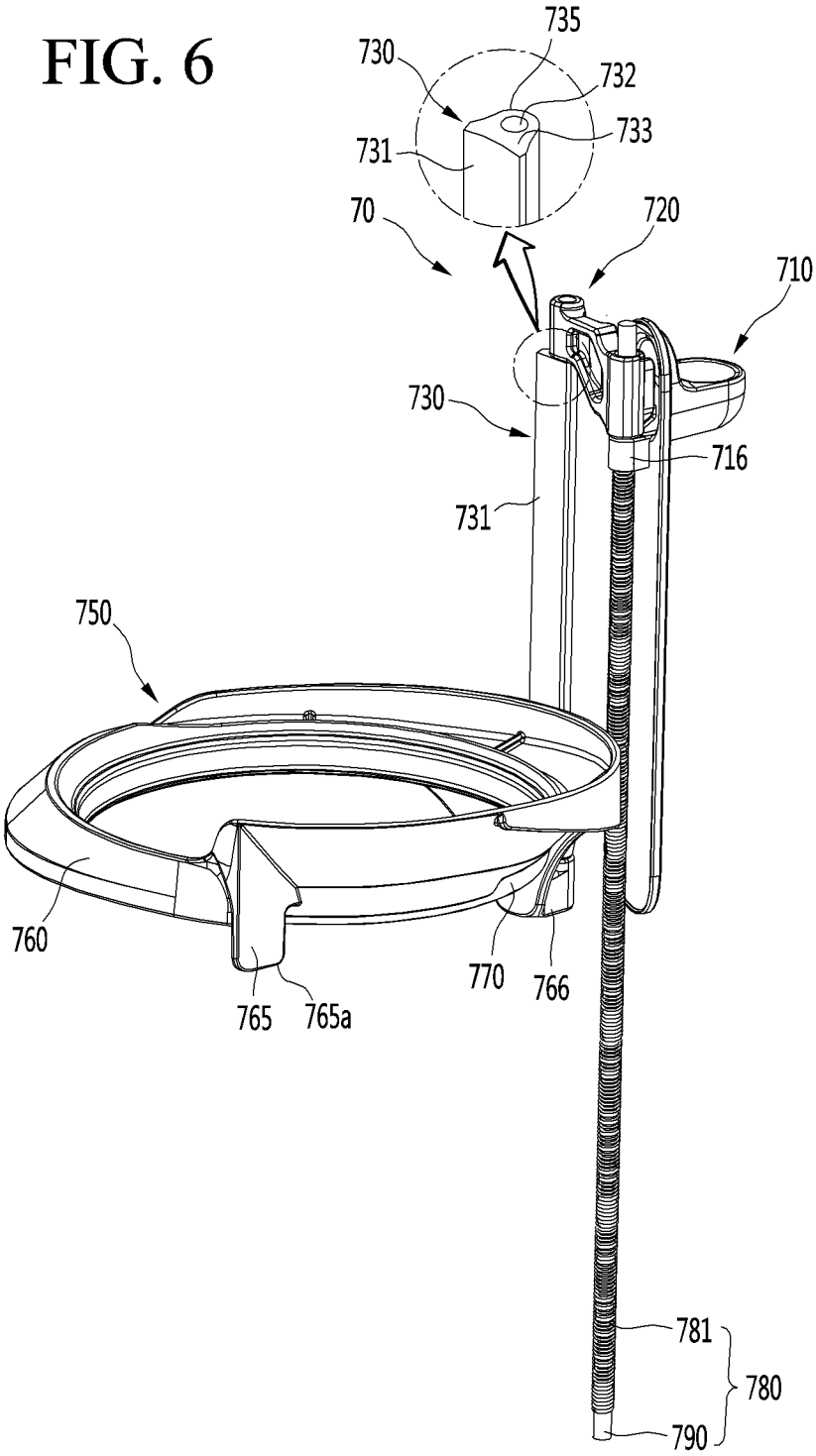
FIG. 6 is a perspective view of a cleaning mechanism according to an embodiment.

Here, the support bar 790 may be coupled to the first transfer part 720 after passing through the coupling protrusion (see reference numeral 716 of FIG. 6). A portion of the coupling protrusion (see reference numeral 716 of FIG. 6) may be coupled to the first transfer part 720.

An upper end of the elastic member 781 may contact a lower side of the coupling protrusion (see reference numeral 716 of FIG. 6).

The other end of the support bar 790 may be an upper end. An upper end of the support bar 790 may be coupled to pass through the first transfer part 720.

The first transfer part 720 may move vertically along the support bar 790. Thus, the support bar 790 may guide the vertical movement of the first transfer part 720. Thus, the support bar 790 may be called a guide bar.

The cleaner 1 may further include the transfer unit cover 64 covering the transfer units 720 and 730.

The transfer unit cover 64 may be coupled to the main body 2 while covering the transfer units 720 and 730.

The transfer unit cover 64 may also cover the support mechanism 780.

A first portion 641 of the transfer unit cover 64 may cover the first transfer part 720, the support bar 790, and the elastic member 781 at a side of the protruding body 180.

A second portion 644 of the transfer unit cover 64 may be disposed above the protruding body 180 and may cover the second transfer portion 730.

The transfer unit cover 64 may include a slot 642 in which the coupling protrusion 722 of the first transfer part 720 is disposed. The slot 642 may be defined long in the vertical direction.

The transfer unit cover 64 may be provided with a bar coupling part 645 to which the support bar 790 is coupled.

The main body 2 may further include a suction motor 220 for generating suction force. The suction force generated by the suction motor 220 may act on the suction part 5.

For example, the suction motor 220 may be disposed in the second housing 12.

The suction motor 220 may be disposed above the dust container 112 and the battery 600 with respect to the extension direction of the axis A1 of the cyclone flow of the first cyclone part 110.

The main body 2 may further include an air guide 170 for guiding air passing through the filter part 130 to the suction motor 220.

For example, the air guide 170 may guide the air discharged from the second cyclone part 140 to the suction motor 220.

The second cyclone part 140 may be coupled to a lower side of the air guide 170. The filter part 130 may surround the second cyclone part 140 in the state in which the filter part 130 is coupled to the second cyclone part 140.

Thus, the filter part 130 may also be disposed below the air guide 170. The movable part 750 may be disposed at a position at which the movable part 750 surrounds the air guide 170 at a standby position.

The movable part 750 may include a cleaning part 770 for cleaning the filter part 130.

In this embodiment, a position of the movable part 750 in the state in which the manipulation part 710 is not manipulated (an initial position of the manipulation part 710) may be referred to as a standby position.

At the standby position of the movable part 750, the entire the cleaning part 770 may be disposed so as not to overlap the filter part 130 in a direction in which air passes through the filter part 130.

For example, the entire cleaning part 770 may be disposed higher than the filter part 130 at the standby position of the movable part 750.

Thus, at the standby position of the movable part 750, it is possible to prevent the cleaning part 770 from acting as flow resistance while the air passes through the filter part 130.

The dust guide 160 may be provided below the second cyclone part 140. A lower side of the second cyclone part 140 may be coupled to an upper side of the dust guide 160. Also, a lower side of the filter part 130 may be seated on the dust guide 160.

The lower side of the dust guide 160 may be seated on the body cover 114. The dust guide 160 is spaced apart from an inner circumferential surface of the first housing 10 to partition the inner space of the first housing 10 into a first dust storage part 120 in which dust separated in the first cyclone part 110 is stored and a second dust storage part 122 in which dust separated in the second cyclone part 140 is stored.

The inner circumferential surface of the first housing 10 and an outer circumferential surface of the dust guide 160 may define the first dust storage part 120, and an inner circumferential surface of the dust guide 160 may define the second dust storage part 122.

Hereinafter, the cleaning mechanism 70 will be described in more detail.

Figure 7:
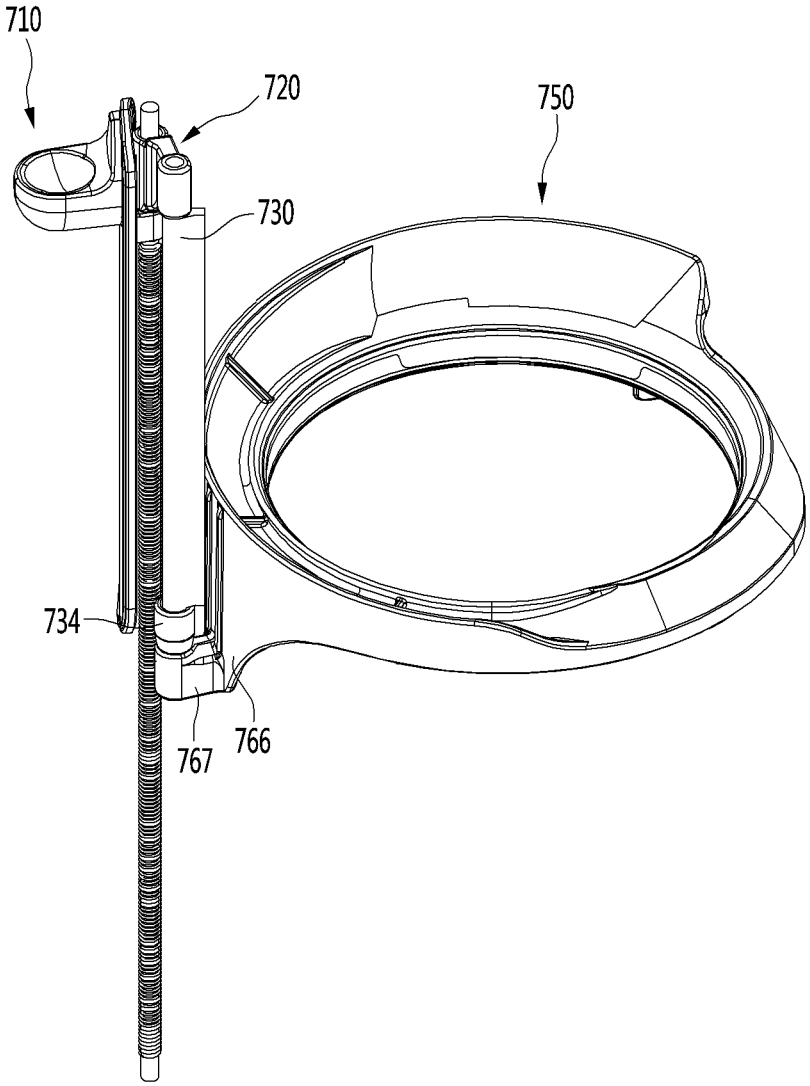
FIG. 7 is another perspective view of a cleaning mechanism according to an embodiment.

FIGS. 6 and 7 are perspective views of the cleaning mechanism according to an embodiment.

Referring to FIGS. 6 and 7, the movable part 750 may include a cleaning part 770 for cleaning the filter part 130 and a frame 760 supporting an outer circumference of the cleaning part 770.

A maximum diameter of the frame 760 may be smaller than a diameter of the inner circumferential surface of the first cyclone part 110. Thus, the frame 760 may move vertically while being spaced apart from the inner circumferential surface of the first cyclone part 110.

The cleaning part 770 may be made of an elastically deformable material. For example, the cleaning part 770 may be made of a rubber material.

The cleaning part 770 may have a ring shape so that the cleaning part 770 clean the entire circumference of the cylindrical filter part 130. For another example, the cleaning part 770 may be made of a silicon or fiber material.

The movable part 750 may move from the first position, which is the standby position, to a second position.

The cleaning part 770 may clean the outer surface of the filter part 130 while being standby at a position that is away from the filter part 130 in the first position and moving to the second position in the cleaning process.

For example, the cleaning part 770 may be coupled to the frame 760 by insert-injection.

The frame 760 may further include a pressing rib 766 extending downward.

The pressing rib 766 may be provided to be rounded in a circumferential direction of the frame 760.

The pressing rib 766 serves to pressurize the dust stored in the dust container 112 downward while the movable part 750 descends.

The frame 760 may further include a coupling part 767 extending outward from the pressing rib 766.

The coupling part 767 may protrude horizontally from the pressure rib 766. For example, the coupling part 767 may extend horizontally from a lower end of the pressing rib 766.

The second transfer part 730 may be connected to the coupling part 767.

A buffer 734 may be coupled to the second transfer part 730. The second transfer part 730 may be coupled to pass through the buffer 734. The buffer 734 may be seated on a top surface of the coupling part 767 in a state of being coupled to the second transfer part 730.

The second transfer part 730 may pass through an upper wall of the protruding body 180.

The buffer 734 absorbs an impact generated when the movable part 750 contacts the upper wall of the protruding body 180 while the movable part 750 moves from the second position to the first position to reduce noise to be generated.

The frame 760 may further include a frame guide 765 extending downward from a position spaced apart from the pressing rib 766.

The frame guide 765 may include a guide surface **765*a* that is flat. The guide surface 765*a* may guide a spiral flow of air while the air is introduced through the suction part 5**.

If the structure for compressing the dust container 112 is applied according to an embodiment, when the dust container 112 is filled with dust, a volume of the dust may be reduced by compressing the dust.

Thus, it is not necessary to frequently empty the dust container 112 by the dust compression, and a phenomenon in which dust is blown when the dust is empty is reduced.

However, since the structure for compressing the dust is provided in the dust container 112, the dust may be introduced into the elevation space in which the second transfer part 730 connected to the movable part 750 moves.

Particularly, in the dust container 112, when the movable part 750 descends, the elevation space above the movable part 750 is exposed, and dust is introduced into the exposed elevation space.

As described above, when the dust of the dust container 112 is introduced into the elevation space of the second transfer part 730, the dust may act as an obstacle to the elevation operation of the movable part 750, and thus, the elevation operation of the movable part 750 may not be smoothly performed.

Particularly, when the movable part 750 descends, the elevation operation of the movable part 750 may be disturbed due to the dust caught between the second transfer part 730 and the elevation space.

Figure 8:
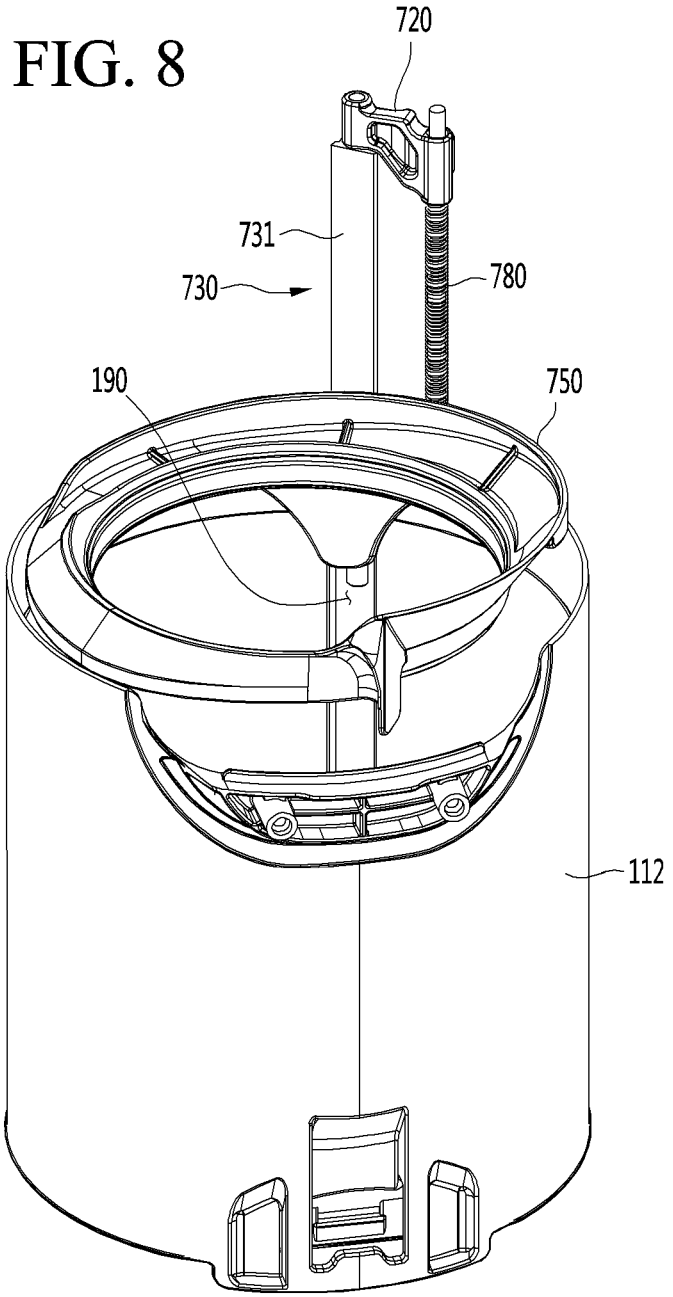
FIG. 8 is a perspective view illustrating a state in which a movable part ascends in a dust container.
Figure 9:
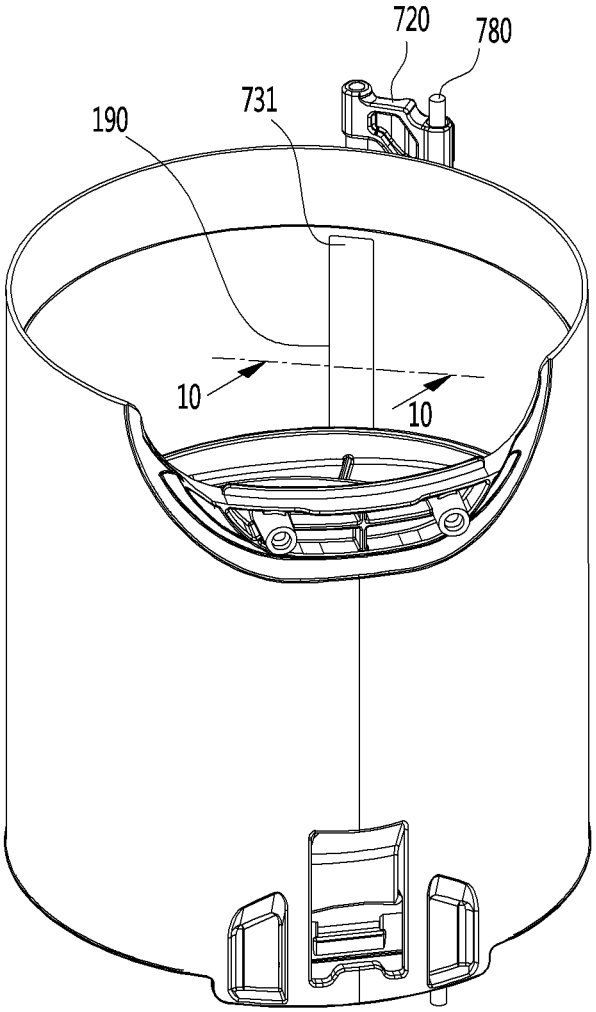
FIG. 9 is a perspective view illustrating a state in which the movable part descends in the dust container.
Figure 10:
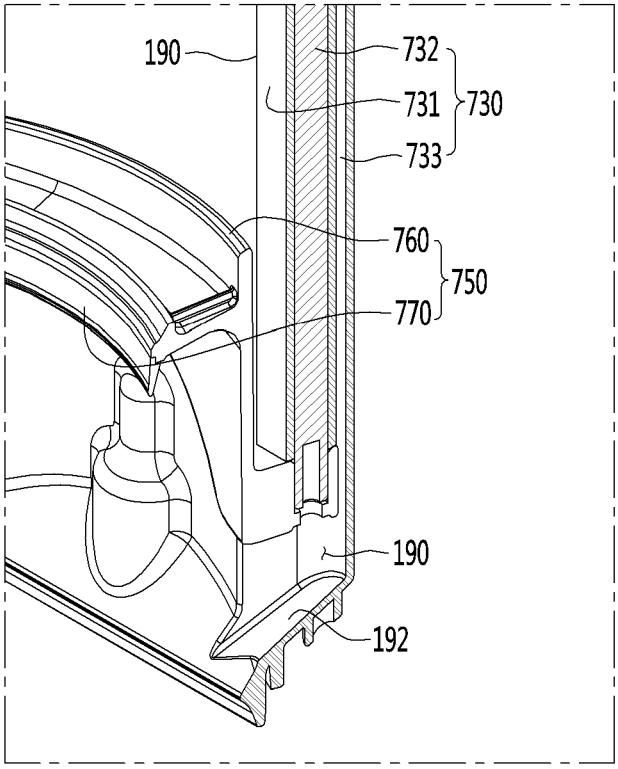
FIG. 10 is a longitudinal cross-sectional view illustrating a state in which the movable part descends in the dust container.
Figure 11:
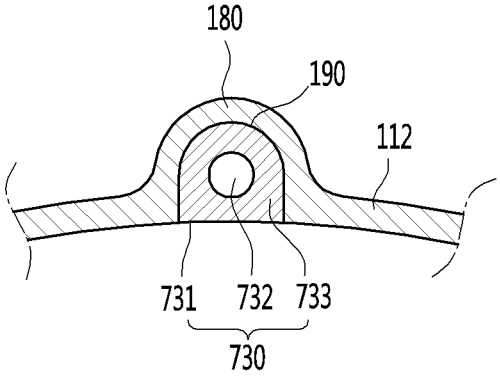
FIG. 11 is a partial perspective view showing a protruding body covering a second transfer portion according to an embodiment.

FIG. 8 is a perspective view illustrating a state in which the movable part ascends in the dust container. FIG. 9 is a perspective view illustrating a state in which the movable part descends in the dust container. FIG. 10 is a longitudinal cross-sectional view illustrating a state in which the movable part descends in the dust container.

Hereinafter, referring to the drawings, a structure for blocking dust to prevent the dust within the dust container from being introduced into the elevation groove 190 defined in the dust container 112 when the movable part 750 is elevated will be described.

Referring FIGS. 8 to 9, the dust container 112 has the elevation groove 190 defined to be recessed outward from the inner surface thereof.

Here, the protruding body 180 protruding outward by the elevation groove 190 may be disposed on the outer surface of the housing 10. That is, the protruding body 180 protruding outward from the outer surface of the housing 10 may be provided by the elevation groove 190 defined to be recessed outward from the inside of the dust container 112.

The elevation groove 190 extends in the vertical direction. The elevation groove 190 may be provided in a straight line.

The elevation groove 190 serves as the elevation space of the second transfer part 730 connected to the movable part 750. At least a portion of the second transfer part 730 may be accommodated in the elevation groove 190 and may be supported by the elevation groove 190 to guide the elevation operation.

During the elevation operation of the movable part 750, the second transfer part 730 may be accommodated in the elevation groove 190.

The movable part 750 may move vertically while being reciprocated between the upper and lower ends of the dust container 112.

For example, as illustrated in FIG. 8, in the state in which the movable part 750 ascends (a state before being pressed), the elevation groove 190 is in an empty state and is exposed to the inner space of the dust container 112.

For another example, as illustrated in FIG. 9, in the state in which the movable part 750 is descends (pressed state), the descending second transmission part 730 is accommodated in the elevation groove 190.

Here, the elevation groove 190 is filled by the second transfer part 730, and thus, the introduction of dust and foreign substances in the dust container 112 may be prevented.

For this, the transverse cross-section of the second transfer part 730 may be provided to correspond to the transverse cross-section of the elevation groove 190.

For example, a shape of the transverse cross-section of the second transfer part 730 may be the same as that of the elevation groove 190.

For another example, a size of the transverse cross-section of the second transfer part 730 may be the same as that of the elevation groove 190.

For another example, an inlet of the elevation groove 190 may be blocked by a blocking wall 731 disposed at one side of the second transfer part 730 facing a center of the dust container 112.

The blocking wall 731 may have the same size as that of the inlet of the elevation groove 190.

Particularly, a horizontal length of the blocking wall 731 may be the same as that of the inlet of the elevation groove 190.

The elevation groove 190 or the second transfer part 730 may have a curved shape because one side facing the outside of the dust container 112 has an arc shape.

In the elevation groove 190 and the second transfer part 730, one side facing the outside of the dust container 112 may have a semicircular cross-sectional shape.

According to the forgoing embodiment, to compress the dust introduced into the dust container 112, the movable part 750 and the second transfer portion 730 descend.

The second transfer part 730 descends along the elevation groove 190, and the second transfer part 730 descends and is accommodated inside the elevation groove 190.

Here, the second transfer part 730 descends while filling the inside of the elevation groove 190.

Also, the blocking wall 731 disposed on one side of the second transfer part 730 blocks an inlet portion of the elevation groove 190.

Thus, the dust of the dust container 112 is not introduced into the elevation groove 190 defined inside the dust container 112.

Also, since a gap is not generated between the elevation groove 190 and the second transfer part 730, the phenomenon in which the dust is caught in the gap may be prevented.

Also, the elevation operation of the second transfer part 730 and the movable part 750 are performed smoothly, and the force applied when the user presses the manipulation part 710 may be reduced. Therefore, when the dust is compressed, the user's feeling of manipulation is improved.

As described above, when the second transfer part 730 and the movable part 750 descend, the elevation groove 190 may be blocked by the second transfer part 730, and thus, the introduction of dust into the elevation groove 190 may be prevented.

However, when the second transfer part 730 and the movable part 750 ascend, the elevation groove 190 is opened to the inside of the dust container 112.

Therefore, in the state in which the second transfer part 730 and the movable part 750 ascend, the dust of the dust container 112 may be essentially introduced into the elevation groove 190.

However, the dust introduced into the elevation groove 190 is pushed downward by the second transfer part 730 when the movable part 750 descends.

Also, the dust pushed downward by the second transfer part 730 may be removed from the elevation groove 190 and collected in the dust container 112.

Here, the dust collected on the lower end of the elevation groove 190 may be collected into the dust container 112 while being slid along an inclined surface (see FIG. 10) disposed to be inclined downward from the lower end of the elevation groove 190 to the inside of the dust container 112.

Referring again to FIG. 10, the second transfer part 730 may include a central shaft having a lower end connected to the movable part 750 and an upper end connected to the first transfer part 720 and a cover portion 733 defining an outer appearance of the second transfer part 730 and passing through the central shaft 732.

The blocking wall 731 may be disposed on one side of the cover portion 733. The central shaft 732 may be made of a metal material to secure strength. The cover portion 733 is made of a plastic material to cover the central shaft 732, and when the cover portion 733 descends while ascending along the elevation groove 190, the elevation groove is blocked to prevent the dust from being introduced into the elevation groove 190.

Here, the cover portion 733 may block the entire elevation groove 190. That is, the second transfer part 730 may block the entire elevation groove 190.

Also, the cover portion 733 may block only the inlet of the elevation groove 190. That is, the second transfer part 730 may block only the inlet of the elevation groove 190.

Also, the cover portion 733 may block only a portion of the inner space of the elevation groove 190. That is, the second transfer part 730 may block only a portion of the inner space of the elevation groove 190.

As described above, according to the present invention, when the movable part and the transfer part are elevated, the gap is not generated between the transfer part and the elevation groove acting as the elevation space of the transfer portion, thereby preventing the dust and foreign substances from being caught in the gap. In addition, to compress the dust in the dust container, when the user presses the manipulation part, the dust accumulated in the elevation groove may be removed while the movable part and the transfer part descend. In addition, the elevation operation of the movable part and the transfer part, which are elevated to compress the dust in the dust container, may be smoothly performed. In addition, after the dust compression, the manipulation part may return to its original position by itself even if the user does not apply force.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a housing having an upper side and a lower side, the lower side defining a dust container with a suction opening formed therein;

a filter part configured to filter particles from air suctioned through the suction opening, the filter being spaced apart from an inner surface of the housing;

an air guide configured to guide the air passing through the filter part to a suction motor configured to generate a suction force;

a movable part provided in a space located between an outer surface of the filter part and the inner surface of the housing, the moveable part configured to be elevated between a first position and a second position;

a manipulation part having at least a portion thereof that is exposed outside of the housing, the manipulation part configured to be moved by a user's manipulation; and a transfer unit having at least a portion thereof that is accommodated inside the housing, the transfer unit configured to connect the manipulation part to the movable part, and wherein the transfer unit comprises:

a first transfer part and a second transfer part, wherein the first transfer part is configured to connect an upper side of the second transfer part to an upper side of the manipulation part, and wherein the second transfer part extends upward from one side of the movable part, and wherein the dust container has an elevation groove formed therein, the elevation groove extending vertically and recessed outward from an inner surface of the dust container, and when the movable part is being elevated, the second transfer part is guided by the elevation groove, and wherein, when the second transfer part descends, an inlet of the elevation groove is blocked by a blocking wall disposed at one side of the second transfer part.

2. The cleaner according to claim 1, wherein a transverse cross-section of the second transfer part corresponds to a transverse cross-section of the elevation groove.

3. The cleaner according to claim 1, wherein, when the second transfer part descends, an inlet of the elevation groove is blocked by a blocking wall disposed at one side of the second transfer part.

4. The cleaner according to claim 1, wherein an inclined surface that is inclined downward to the inside of the dust container is disposed on a lower end of the elevation groove.

5. The cleaner according to claim 1, wherein a protruding body for guiding the second transfer part, the protruding body protruding outside of the elevation groove is disposed on an outer surface of the housing.

6. The cleaner according to claim 1, wherein the second transfer part comprises:

a central shaft having a lower end connected to the movable part and an upper end connected to the first transfer part; and a cover portion configured to define an outer appearance of the second transfer part when covering the central shaft and which receives the central shaft.

7. The cleaner according to claim 1, wherein the elevation groove or the second transfer part has a curved shape because one side facing the outside of the dust container has an arc shape.

8. The cleaner according to claim 1, wherein the movable part is elevated between an upper end and a lower end of the dust container.

9. The cleaner according to claim 1, wherein the portion of the manipulation part that is exposed to the outside of the housing extends in a horizontal direction.

10. The cleaner according to claim 1, further comprising an elastic member configured to provide an elastic force to the manipulation part or the transfer unit.

11. The cleaner according to claim 10, wherein the elastic force of the elastic member pushes the manipulation part upward.

12. The cleaner according to claim 11, wherein a support bar extending vertically is provided outside of the housing, and the elastic member is inserted into an outer circumferential surface of the support bar.

13. The cleaner according to claim 1, wherein a handle part is disposed outside of the housing, and the manipulation part is disposed adjacent to one side of the handle part.

14. The cleaner according to claim 1, wherein the dust container has a protruding body formed therein, the protruding body extending vertically and protruding outward from an outer surface of the dust container, and wherein the elevation groove is defined an inner space of the protruding body.

* * * * *